United States Patent [19]

Phelps

[11] Patent Number: 4,484,781

[45] Date of Patent: Nov. 27, 1984

[54] FLOTATION CHAIR

[76] Inventor: Kelsey L. Phelps, 880 W. Riverdale Rd., Ogden, Utah 84405

[21] Appl. No.: 371,975

[22] Filed: Apr. 26, 1982

[51] Int. Cl.[3] ..... A47C 7/02

[52] U.S. Cl. ..... 297/452; 5/449; 297/456; 297/DIG. 3

[58] Field of Search ..... 297/DIG. 3, 452, 456; 5/441, 442, 446, 449, 450, 455, 417, 419, 420, 462, 465, 480

[56] References Cited

U.S. PATENT DOCUMENTS

| | | | |
|---|---|---|---|
| 2,612,645 | 10/1952 | Boland | 297/DIG. 3 |
| 2,843,181 | 7/1958 | Paschen | 297/DIG. 3 |
| 2,987,735 | 6/1961 | Nail | 297/DIG. 3 |
| 3,572,836 | 11/1968 | Khanh | 297/DIG. 3 |
| 3,860,976 | 1/1975 | Suyama | 297/DIG. 3 |
| 4,031,578 | 6/1977 | Sweeney et al. | 5/441 X |
| 4,171,549 | 10/1979 | Morrell | 5/449 |

FOREIGN PATENT DOCUMENTS

| | | | |
|---|---|---|---|
| 1034337 | 7/1968 | Fed. Rep. of Germany | 5/455 |

*Primary Examiner*—James T. McCall

[57] ABSTRACT

A chair is provided which includes a low, rectangular seat cushion positioned between two large wedge-shaped cushions, one of which forms a backrest while the other forms a leg rest. The cushions are formed from individual air bags inserted within separate compartments in an upholstery cover and then inflated.

8 Claims, 4 Drawing Figures

FLOTATION CHAIR

BACKGROUND OF THE INVENTION

1. Field

The invention is in the field of flotation furniture for supporting the full weight and length of the user on a cushion of air.

2. State of the Art

Flotation chairs heretofore known have generally been of the bean-bag type which comprises a large, circular bag partially filled with loose, granular polystyrene pellets or beads. The bag is then pushed or punched to form a seat and back rest for the user. Such chairs are bulky and clumbsy to transport and do not lend themselves to adjustment of the level of the filler material to suit the individual user.

Plastic chairs having a seat, back rest and armrests formed from styrofoam have been proposed, primarily for use in swimming pools to support the user on the surface of the pool. While these chairs are bouyant, they are also fragile and susceptible to breakage under frequent use and are not suitable for use outside a pool.

Inflatable armchairs made of plastic sheet material have been proposed for infants or as toys for children. Such chairs have been unsatisfactory for adult use for various reasons, including the fact that they are unstable due to the movement of air within the chair as the use shifts position, the fact that the plastic material is impervious and non-absorbent causing the user to stick to the chair, and the fact that the plastic stretches under use resulting in early failure and consequent limited effective life of the chair.

SUMMARY OF THE INVENTION

According to the invention a chair is provided which includes an elongated base panel with two wedge-shaped rests projecting upwardly from the base. The rests are of different size and are spaced from each other with the space between them occupied by a low, rectangular cushion. The two wedge-shaped rests and the low rectangular cushion are inflatable and are enclosed within a covering of fabric or other durable material. The larger rest provides a backrest, the rectangular cushion forms a seat and the smaller rest forms a legrest.

The covering is sewn to the base panel to form a unitary enclosure with openings in the base to receive the inflatible vinyl air bags which form the rests and the cushion. The smaller rest has an isosceles triangular cross-section to support the legs of the user essentially from the hip to the ankle. The larger rest is also triangular in cross-section, either isosceles or right, to provide support for the users back throughout its length. A separate small enclosure is attached to the apex of the larger rest and receives a small air bag which is inflatible to form a pillow adjacent the upper edge of the backrest.

DRAWINGS

The best mode presently contemplated of carrying out the invention will be understood from the detailed description of the emodiment illustrated in the accompanying drawing in which.

DETAILED DESCRIPTION OF THE ILLUSTRATED EMBODIMENT

Figure 1:
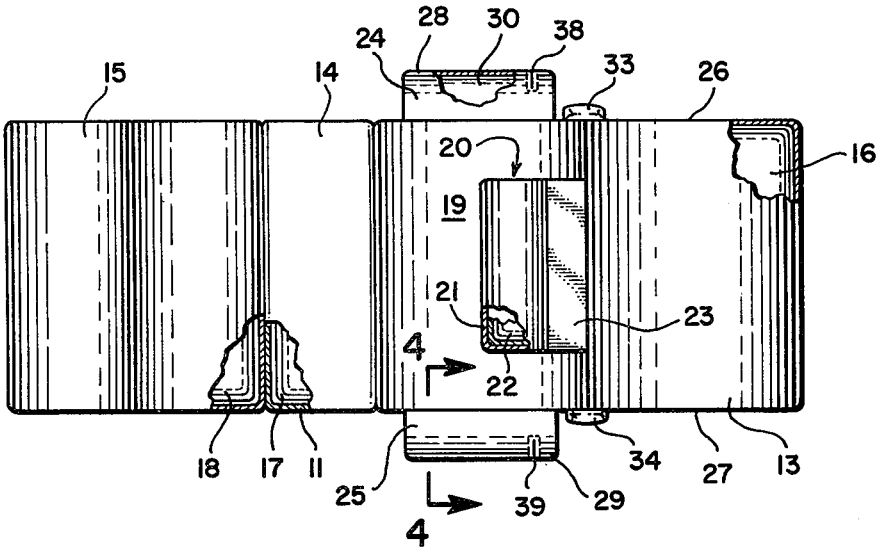
FIG. 1 is a plan view partly in section of a flotation chair according to the present invention.
Figure 2:
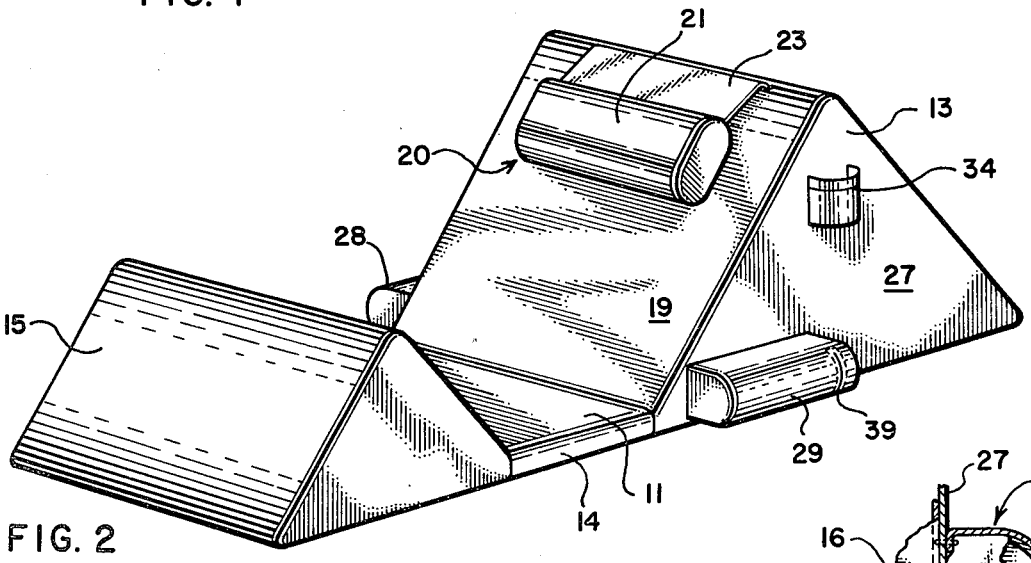
FIG. 2 is a perspective view of the chair of FIG. 1.
Figure 3:
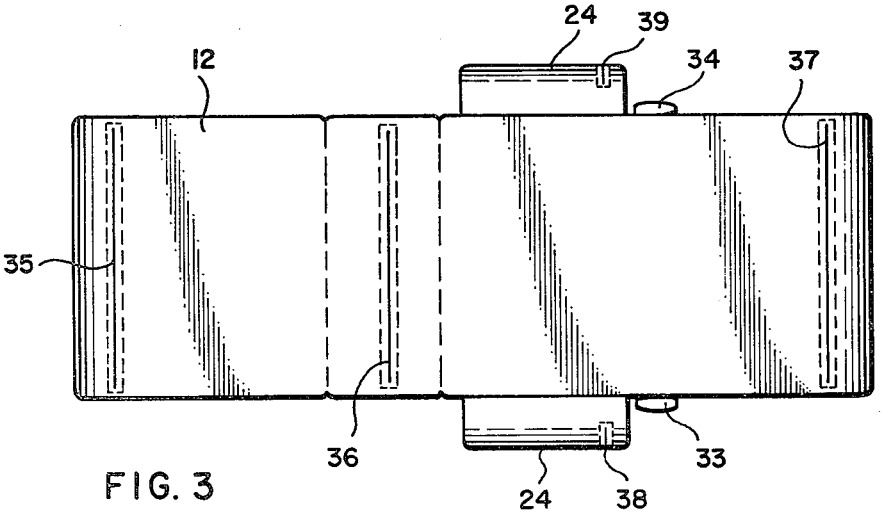
FIG. 3 is a bottom view of the base panel showing the openings for placement of the air bags.

As illustrated in FIG. 1, the present flotation chair includes a cover 11 in the form of an enclosure having a base panel 12, FIG. 3, and three compartments 13, 14, 15. The cover is constructed of a durable yet pliable material such as upholstery fabric, fabric backed artificial leather, denim, canvas, etc. A separate air bag is received within each compartment. A large air bag 16 is received within compartment 13, a low, rectangular bag 17 is received within compartment 14, and a smaller air bag 18 is received within compartment 15. The air bags are made of heavy guage vinyl plastic with the seams joined by a suitable solvent or by di-electric welding. A suitable commercially available air valve with an air-retaining cap is provided in each bag to inflate or deflate the bag as desired. The air bags 16 and 18 are wedge-shaped and have a triangular cross-section. The smaller bag 18 is approximately twelve inches in height and has an isosceles triangular cross-section. The larger bag 16 is approximately fourteen to eighteen inches in height and may be of right triangular or isosceles triangular cross-section as desired. In either case the front panel 19 of the backrest, and the corresponding panel of the air bag 16, should be at an angle of between 10 to 45 degrees with the base panel 12.

A pillow 20 is provided adjacent the upper edge of the compartment 13 and includes an enclosure 21 of soft, pliable yet durable material or fabric which encases a small air bag 22. The air bag 22 is made of vinyl and is similar to bags 16–18 except in size and shape. The enclosure 21 includes a flap 23 which is secured to the cover 11 at the upper edge of compartment 13 as by being sewn into a seam along said upper edge.

Figure 4:
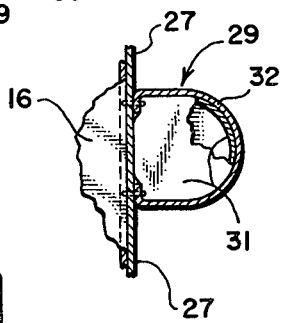
FIG. 4 is a transverse section of the armrest taken along line 4—4 of FIG. 1.

A pair of armrests 24, 25 are mounted on the end panels 26, 27 of compartment 13 and include an elongated generally-cylindrical enclosure 28, 29. A cylindrical air bag, shown at 30 in FIG. 1 and 31 in FIG. 4, is received within each armrest enclosure. The enclosures 28, 29 are formed by stitching or otherwise securing the longitudinal edges of a strip of material 32 to the end panels to form a loop, as shown in FIG. 4. The open ends of the resultant tubular enclosure are closed by switching small pieces to the panels and the edges of the strip. A pocket 33, 34 is sewn or otherwise secured to each of the end panels 26, 27.

A series of openings 35, 36, 37 are provided in the base panel 12 and located under each of the compartments for placement of the air bags in the associated compartment. Similar openings 38, 39 are provided on in the armrest enclosures 28, 29. An opening is also provided on the underside of the pillow enclosure 21. Each of these openings is provided with a suitable closure device, such as a zipper or velcro closure or etc. Each of the air bags 16, 17, 18, 22, 30, 31 is partially inflated and then inserted through the proper opening into its associated compartment or enclosure. Each bag is then inflated to the desired extent and the air valve capped to retain the air. The level of air pressure within the individual air bags can be adjusted by the user to his own satisfaction or comfort.

The three compartments in the cover 11 with the three associated air bags support the user in a reclining position with a minimum of rocking or bobbing. Since each air bag is self contained and there is no exchange of air between the compartments, the weight of the user is borne by the three air bags in combination. This provided a soft yet stable support the only instability arising from the displacement of air within an individual air bag as the weight of the user is shifted when his position is changed. While the cover provides a decorative and comfortable surface for the chair, it also contributes materially to the utility and life of the chair. In this regard, it is important that the air bags 16, 17, 18 be dimensioned to fit snugly within the associated compartments 13, 14, 15. The cover will then restrict the expansion of the vinyl and maintain the shape of the air bags. This will prevent the vinyl material of the air bags from stretching under the weight of the user and thus prolong the effective life of the air bags and the chair. If the vinyl air bags were not supported by the material of the cover, the repeated stretching of the vinyl under load would cause it to fail or the seams to open.

While the present flotation chair has been illustrated with a width suitable for single use, it is contemplated that the width can be extended for double use. In such case, two air bags would be used, end to end, within each compartment 13, 14, 15 instead of a single long air bag. This would avoid long seams on the air bags and prevent excessive transfer of air from side of the chair to the other.

The present flotation chair has been illustrated with air bags as the means of weight bearing support because of the ability of adjusting the pressure to the satisfaction of the individual user and the ease and simplicity of transportation when the bags are deflated. However, it is contemplated that in some applications where portibility is unimportant and complete stability is desired, the bag 17 and perhaps bags 16 and 18 may be replaced with cushions of foam material of the requisite size and shape.

While the invention has been described with reference to specifically illustrated preferred embodiments, it should be realized that various changes may be made without departing from the disclosed inventive subject matter particularly pointed out and claimed herebelow.

I claim:

1. A flotation chair for supporting the user in a reclining position, said chair including a covering of durable pliable material forming an enclosure with three compartments formed therein, each compartment having an access opening and closure means for selectively opening and closing each access opening, three separate cushions each of which is removably received within a compartment, two of said cushions being wedge-shaped and the third being rectangular, said two cushions being spaced apart and positioned on either side of the third cushion, said covering closely surrounding and supporting the cushions to maintain their shape and resist distortion and deformation thereof.

2. A flotation chair as defined in claim 1 wherein the two wedge-shaped cushions are inflatable air bags, one of which is smaller than the other.

3. A flotation chair as defined in claim 2 wherein the smaller inflatable air bag has an isosceles triangular cross-section and forms a legrest for the user.

4. A flotation chair as defined in claim 3 wherein the larger inflatable air bag has a triangular cross-section and forms a backrest.

5. A flotation chair as defined in claim 4 wherein the intermediate cushion is an inflatable air bag and forms a seat of the chair.

6. A flotation chair as defined in claim 5 wherein a pillow is attached to the compartment containing the larger air bag, said pillow including an air bag as a cushion.

7. A flotation chair as defined in claim 5 wherein armrests are attached to the compartment containing the larger air bag, each armest including a generally cylindrical air bag.

8. A flotation chair as defined in claim 5 wherein the covering includes a base panel which forms one wall of each compartment, said access openings are formed in the base panel, and the closure means is a zipper.

* * * * *